US006568924B2

(12) United States Patent
Kawamura et al.

(10) Patent No.: US 6,568,924 B2
(45) Date of Patent: May 27, 2003

(54) SWASH PLATE TYPE COMPRESSOR HAVING PULSATION DAMPING STRUCTURE

(75) Inventors: Makoto Kawamura, Tochigi (JP); Shinichiro Higashihara, Tochigi (JP)

(73) Assignee: Calsonic Kansei Corporation, Tokyo (JP)

( * ) Notice: Subject to any disclaimer, the term of this patent is extended or adjusted under 35 U.S.C. 154(b) by 95 days.

(21) Appl. No.: 09/938,300

(22) Filed: Aug. 24, 2001

(65) Prior Publication Data

US 2002/0031435 A1 Mar. 14, 2002

(30) Foreign Application Priority Data

Sep. 4, 2000 (JP) ..... 2000-267555
Dec. 22, 2000 (JP) ..... 2000-391183

(51) Int. Cl.[7] ..... F04B 11/00
(52) U.S. Cl. ..... 417/540; 417/312
(58) Field of Search ..... 417/540, 312, 417/269, 222.2

(56) References Cited

U.S. PATENT DOCUMENTS 4,534,710 A * 8/1985 Higuchi et al. ..... 417/269
4,929,157 A * 5/1990 Steele et al. ..... 417/312
4,930,995 A * 6/1990 Suzuki et al. ..... 417/312
5,533,871 A * 7/1996 Takenaka et al. ..... 417/269
5,899,670 A * 5/1999 Ikeda et al. ..... 417/312
6,149,397 A * 11/2000 Mizutani et al. ..... 417/222.2
6,296,457 B1 * 10/2001 Shintoku et al. ..... 417/312
6,386,846 B1 * 5/2002 Murase et al. ..... 417/540
6,390,786 B1 * 5/2002 Gennami et al. ..... 417/269
6,488,487 B2 * 12/2002 Minato ..... 417/540

* cited by examiner

*Primary Examiner*—Teresa Walberg
*Assistant Examiner*—Vinod D. Patel
(74) *Attorney, Agent, or Firm*—Foley & Lardner

(57) ABSTRACT

A swash plate type compressor comprises a cylinder block; a rotation shaft rotatably held in the cylinder block; a swash plate swingably connected to the rotation shaft to rotate therewith; a plurality of piston bores circumferentially arranged about the rotation shaft; a plurality of pistons operatively received in the piston bores respectively, each piston having a holding portion that slidably holds a peripheral portion of the swash plate, so that when the rotation shaft is rotated about its axis, the swash plate pulls and pushes the pistons thereby to reciprocate the same; a valve plate connected to a rear end of the cylinder block, the valve plate having a group of inlet openings connected to the piston bores respectively and another group of outlet openings connected to the piston bores respectively; a rear head connected to the valve plate, the rear head having an intake chamber exposed to the inlet openings and a discharge chamber exposed to the outlet openings, the intake chamber surrounding the discharge chamber, the rear head having an intake port connected to the intake chamber and a discharge port connected to the discharge chamber. An obstruction plate is installed in the intake chamber to obstruct a direct flow of a refrigerant gas from the intake port to a given group of the inlet openings.

15 Claims, 15 Drawing Sheets

SWASH PLATE TYPE COMPRESSOR HAVING PULSATION DAMPING STRUCTURE

BACKGROUND OF THE INVENTION

1. Field of the Invention

The present invention relates in general to swash plate type compressors employed in an automotive air conditioning system, and more particularly to the swash plate type compressors of a type having a pulsation damping structure.

2. Description of the Related Art

In order to clarify the task of the present invention, a known swash plate type compressor will be briefly described with reference to FIGS. 16 and 17 of the accompanying drawings.

In FIG. 16, there is shown the known swash plate type compressor for use in an automotive air conditioner system, which comprises a cylinder block 2 in which a rotation shaft 10 is rotatably held. A rear head 6 is attached to a rear end of the cylinder block 2 through a valve plate 9. A swash plate 15 is pivotally held on the rotation shaft 10 through a holder arm 15*a* fixed to the rotation shaft 10. Designated by numeral 5 is a crank chamber defined in the cylinder block 2. Six cylindrical piston bores 3 are circumferentially arranged around the right end of the rotation shaft 10, each having a piston 18 axially slidably received therein. Each piston 18 has a holding portion that slidably holds a peripheral portion of the swash plate 15. Thus, when, with the swash plate 15 kept inclined relative to the rotation shaft 10 as shown, the rotation shaft 10 is rotated about its axis, the swash plate 15 rotates therewith thereby to pull and push (viz., reciprocate) the pistons 18 in the associated piston bores 3 one after another. Due to the reciprocating movement of each piston 18, a refrigerant gas is led into each piston bore 3 from a refrigerant intake chamber 7 through an inlet opening 3A, compressed in the piston bore 3 and then discharged to a refrigerant discharge chamber 8 through an outlet opening 3B. The outlet opening 3B is equipped with a valve plate 3*b* that permits only a discharge flow of the refrigerant from the piston bore 8 to the discharge chamber 8. The inlet and outlet openings 3A and 3B are formed in the valve plate 9, as shown. The refrigerant intake and discharge chambers 7 and 8 are defined by a generally annular partition wall 11 formed in an inner side of the rear head 6. That is, the refrigerant intake chamber 7 extends circumferentially around the annular partition wall 11. As is seen from FIG. 17, the refrigerant intake chamber 7 is connected with a refrigerant intake port 12, and the refrigerant discharge chamber 8 is connected with a refrigerant discharge port (not shown).

When the rotation shaft 10 is rotated about its axis and thus the pistons 18 are forced to reciprocate in the corresponding piston bores 3, a refrigerant gas from an evaporator (not shown) is led into the refrigerant intake chamber 7 through the refrigerant intake port 12, and led into the piston bores 3 and compressed one after another by the corresponding pistons 18. The compressed refrigerant is then led to the refrigerant discharge chamber 8 through the respective outlet openings 3B and led to a condenser (not shown).

SUMMARY OF THE INVENTION

However, due to inherent construction of the above-mentioned compressor, under operation, a certain pressure difference tends to occur between a position near the refrigerant intake port 12 (see FIG. 17) and a position remote from the intake port 12. It has been revealed that such pressure difference is caused by a pressure loss inevitably produced when the refrigerant gas flows from the intake port 12 toward the inside of the refrigerant intake chamber 7. However, when, under appearance of such pressure difference, the refrigerant gas is led into the piston bores 3 through the inlet openings 3A, the flow of the refrigerant gas tends to produce undesirable pulsation in accordance with the pressure difference and/or the unevenness of the pressure in the refrigerant intake chamber 7. In addition to this, since the rear head 6 is commonly equipped with both a flow control valve (not shown) for the refrigerant gas and an actuating mechanism (not shown) for the flow control valve, the refrigerant intake chamber 7 is compelled to have a complicated shape, which promotes creation of the undesired pressure difference in the chamber 7.

The above-mentioned undesirable phenomenon may be much clarified from the following description with the aid of FIG. 17. That is, under operation of the compressor 6, the pressure at the portion B1 for a first piston bore 3 is kept higher than that at the portion B2 and/or B3, which causes the pressure difference in the intake chamber 7 and thus generation of pulsation of the refrigerant gas flow. As is known, such pulsation causes generation of vibration and/or noises of the compressor. Although enlargement of the refrigerant intake chamber 7 may reduce or dampen the pressure difference, the same causes enlargement of the entire construction of the compressor.

Accordingly, an object of the present invention is to provide a swash plate type compressor which is free of the above-mentioned drawbacks.

That is, according to the present invention, there is provided a swash plate type compressor which can dampen the undesirable pulsation of a refrigerant flow thereinto irrespective of its simple and compact construction.

According to a first aspect of the present invention, there is provided a compressor which comprises a cylinder block; compressing means installed in the cylinder block to compress a refrigerant gas led thereinto; a valve plate connected to a rear end of the cylinder block, the valve plate having a group of inlet openings which are connected to the compressing means to introduce a refrigerant gas into the compressing means and another group of outlet openings which are connected to the compressing means to discharge the refrigerant gas thus compressed from the compressing means; a rear head connected to the valve plate, the rear head having an intake chamber exposed to the inlet openings and a discharge chamber exposed to the outlet openings, the intake chamber surrounding the charge chamber, the rear head having an intake port connected to the annular intake chamber and a discharge port connected to the circular discharge chamber; and a baffle plate installed in the intake chamber to obstruct a direct flow of the refrigerant gas from the intake port to the inlet openings.

According to a second aspect of the present invention, there is provided a swash plate type compressor which comprises a cylinder block; a rotation shaft rotatably held in the cylinder block; a swash plate swingably connected to the rotation shaft to rotate therewith; a plurality of piston bores circumferentially arranged about the rotation shaft; a plurality of pistons operatively received in the piston bores respectively, each piston having a holding portion that slidably holds a peripheral portion of the swash plate, so that when the rotation shaft is rotated about its axis, the swash plate pulls and pushes the pistons thereby to reciprocate the same; a valve plate connected to a rear end of the cylinder block, the valve plate having a group of inlet openings connected to the piston bores respectively and another group of outlet openings connected to the piston bores respectively; a rear head connected to the valve plate, the rear head having an intake chamber exposed to the inlet openings and a discharge chamber exposed to the outlet openings, the intake chamber surrounding the discharge chamber, the rear head having an intake port connected to the intake chamber and a discharge port connected to the discharge chamber; and a baffle plate installed in the annular intake chamber to obstruct a direct flow of a refrigerant gas from the intake port to the inlet openings.

According to a third aspect of the present invention, there is provided a compressor which comprises a cylinder block; compressing means installed in the cylinder block to compress a refrigerant gas led thereinto; a valve plate connected to a rear end of the cylinder block, the valve plate having a group of inlet openings connected to the piston bores respectively and another group of outlet openings connected to the piston bores respectively, each outlet opening having a valve plate that permits only a discharge flow of the refrigerant gas from the piston bore; a rear head connected to the valve plate, the rear head having a generally annular intake chamber exposed to the inlet openings and a generally circular discharge chamber exposed to the outlet openings, the rear head having an intake port connected to the annular intake chamber and a discharge port connected to the circular discharge chamber; and an arcuate baffle plate installed in the generally annular intake chamber in a manner to obstruct a direct flow the refrigerant gas from the intake port to a given group of the inlet openings.

According to a fourth aspect of the present invention, there is provided a swash plate type compressor which comprises a cylinder block; a rotation shaft rotatably held in the cylinder block; a swash plate swingably connected to the rotation shaft to rotate therewith; a plurality of piston bores defined in the cylinder block and circumferentially arranged about the rotation shaft; a plurality of pistons operatively received in the piston bores respectively, each piston having a holding portion that slidably holds a peripheral portion of the swash plate, so that when the rotation plate is rotated about its axis, the swash plate pulls and pushes the pistons thereby to reciprocate the same; a valve plate connected to a rear end of the cylinder block, the valve plate having a group of inlet openings connected to the piston bores respectively and another group of outlet openings connected to the piston bores respectively, each outlet opening having a valve plate that permits only a discharge flow of a refrigerant gas from the piston bore; a rear head connected to the valve plate, the rear head having a generally annular intake chamber exposed to the inlet openings and a generally circular discharge chamber exposed to the outlet openings, the rear head having an intake port connected to the annular intake chamber and a discharge port connected to the circular discharge chamber; and an arcuate baffle plate installed in the generally annular intake chamber in a manner to obstruct a direct flow the refrigerant gas from the intake port to a given group of the inlet openings.

SUMMARY OF THE DRAWINGS

Other objects and advantages of the present invention will become apparent from the following description when taken in conjunction with the accompanying drawings, in which.

DETAILED DESCRIPTION OF THE EMBODIMENTS

In the following, embodiments of the present invention will be described in detail with reference to the accompanying drawings. However, since the embodiments of the invention are substantially same as the above-mentioned known swash plate type compressor of FIGS. 16 and 17 except the rear head 6, only the rear heads for the embodiments will be described in the following.

Figure 1:
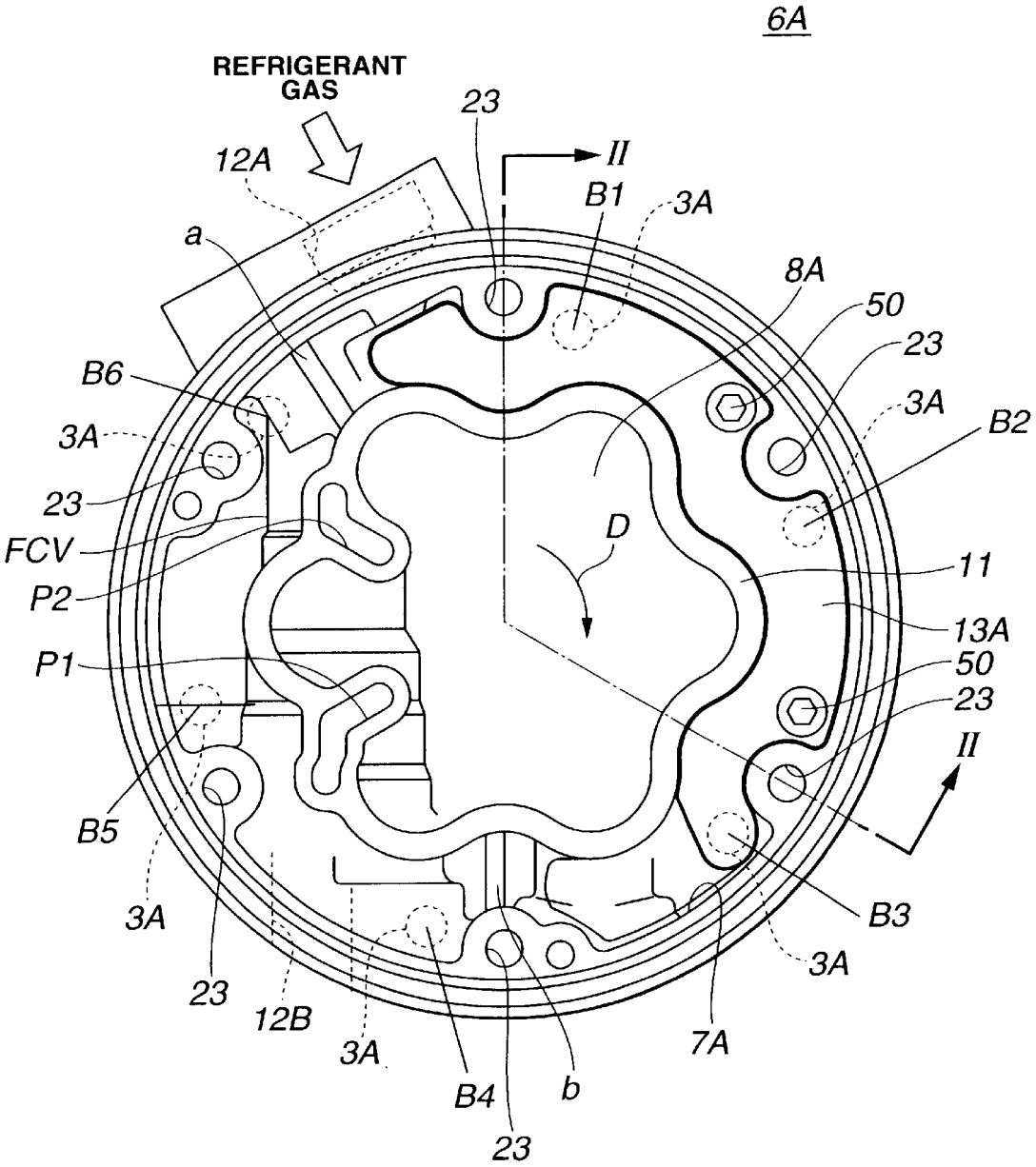
FIG. 1 is a plan view of a pulsation reducing structure employed in a swash plate type compressor of a first embodiment of the present invention.
Figure 2:
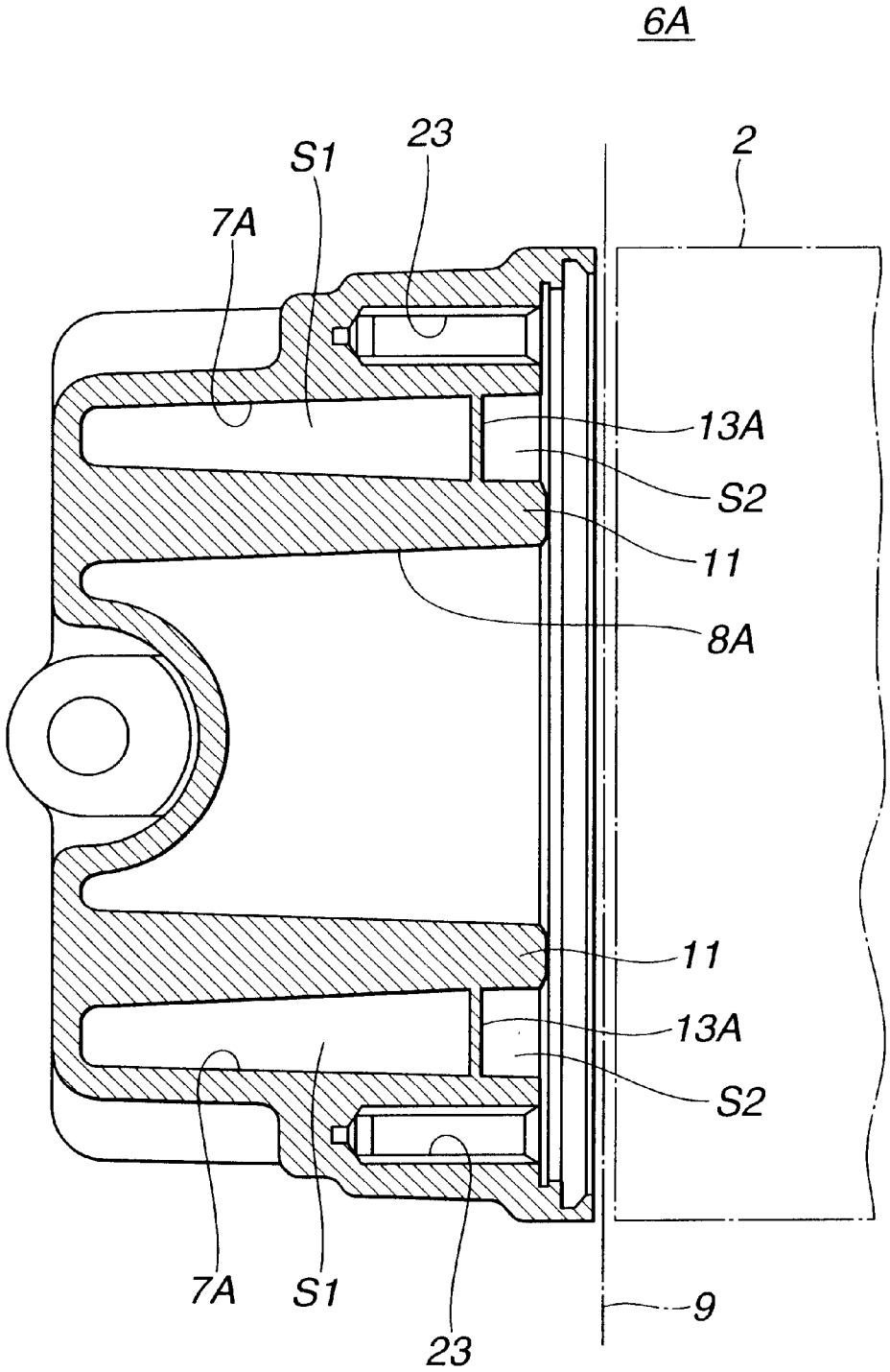
FIG. 2 is a sectional view taken along the line II—II of FIG. 1.

Referring to FIGS. 1 and 2, there is shown a rear head 6A which is employed in the swash plate type compressor of a first embodiment of the present invention. The rear head 6A is constructed to have a pulsation reducing structure in its inner side, as will be described in the following. As has been mentioned hereinabove, the rear head 6A is a member tightly attached to the rear end of the cylinder block 2 (see FIG. 16) through the valve plate 9. For the tight attaching to the cylinder block 2, six column portions 23 are integrally formed in the inner side of the rear head 6A, each having a threaded bore for engaging with a bolt (not shown) extending from the cylinder block 2.

Figure 16:
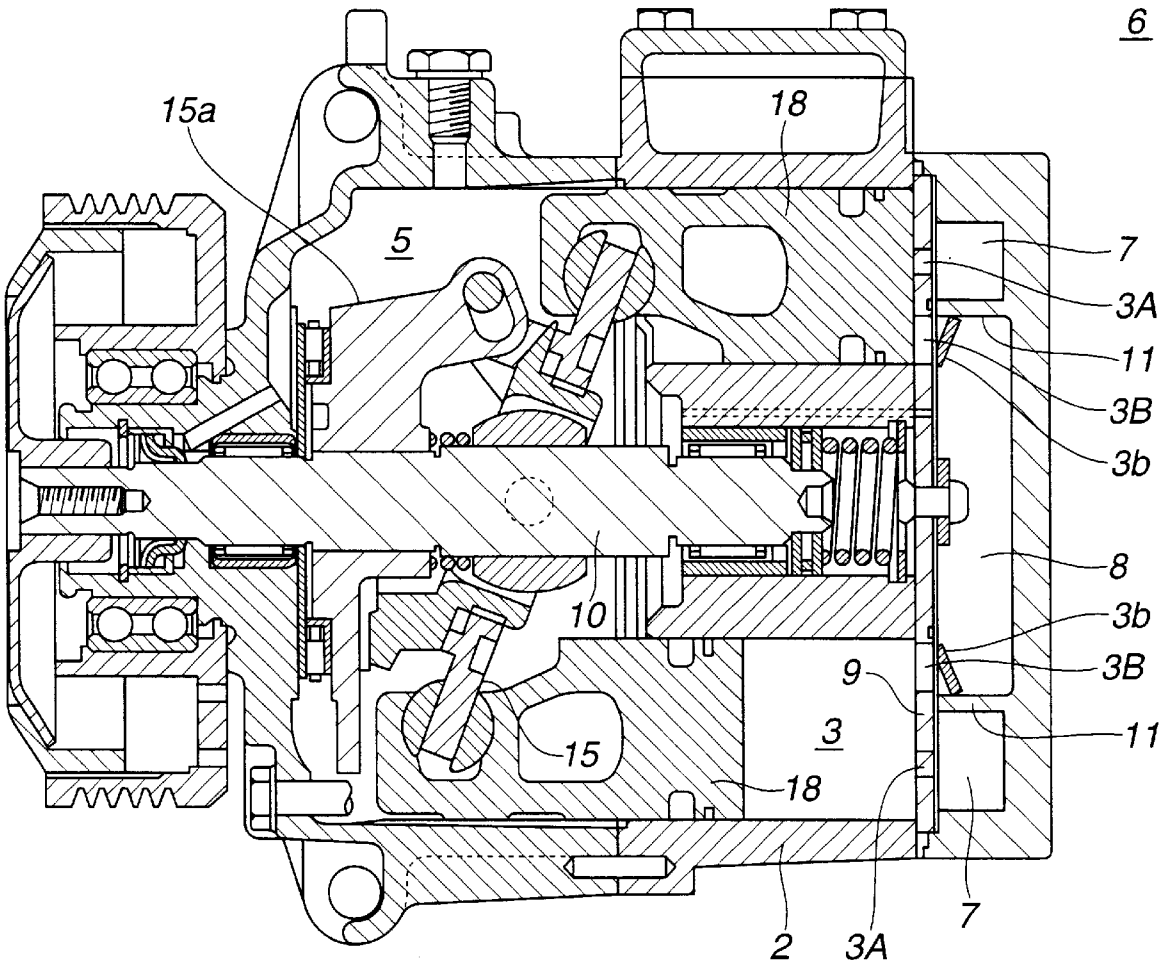
FIG.16 (RELATED ART)
FIG. 16 is a sectional view of a known swash plate type compressor.
Figure 17:
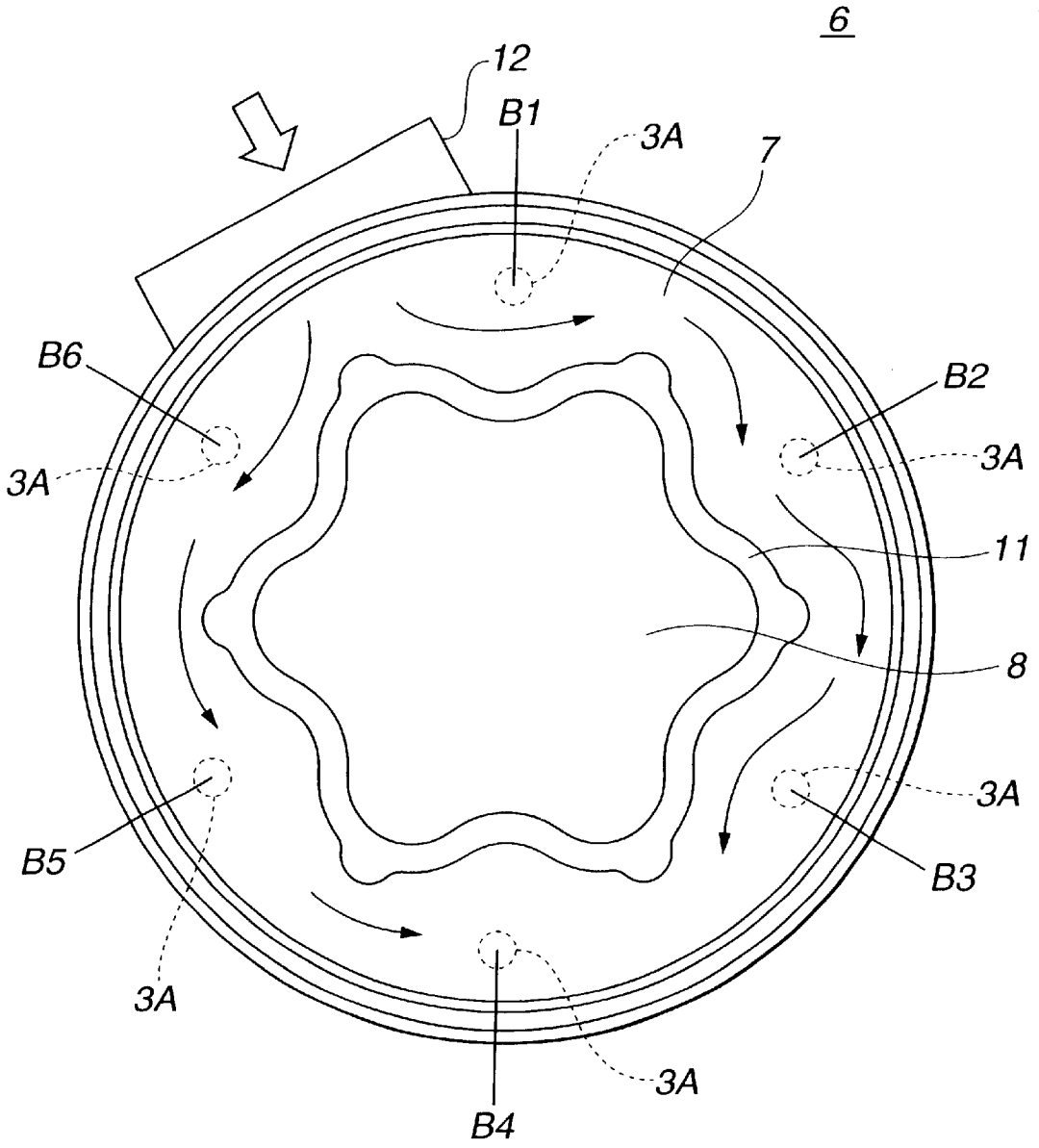
FIG.17 (RELATED ART)
FIG. 17 is a plan view of a rear head employed in the known swash plate type compressor.

As is seen from FIGS. 1 and 2, like in the known rear head 6 of FIG. 16, the rear head 6A is constructed to incorporate with a compressor having six pistons 18. That is, six inlet openings 3A for the respective piston bores 3 are formed in the valve plate 9 at equally spaced intervals.

It is to be noted that portions of the rear head 6A that face the six inlet openings 3A are denoted by references B1, B2, B3, B4, B5 and B6 respectively. It is further to be noted that these portions B1, B2, B3, B4, B5 and B6 correspond to first, second, third, fourth, fifth and sixth piston bores 3 with respect to a normal rotation direction of the rotation shaft 10, which is indicated by an arrow "D" in FIG. 1.

The rear head 6A is formed at the inner side thereof with refrigerant intake and discharge chambers 7A and 8A which are partitioned by a generally annular partition wall 11. That is, the intake chamber 7A is shaped generally annular and arranged to surround the annular partition wall 11 which is generally circular. More specifically, the annular intake chamber 7A is defined between an outer surface of the annular partition wall 11 and an inner surface of a cylindrical outer wall of the rear head 6A. The intake chamber 7A is connected with a refrigerant intake port 12A, and the discharge chamber 8A is connected with a refrigerant discharge port 12B which is provided at a diametrically opposite position of the intake port 12A. The intake port 12A is positioned between the portions B1 and B6, as shown.

In this first embodiment 6A, as is understood from the drawings, a baffle plate 13A is arranged in the refrigerant intake chamber 7A. That is, the baffle plate 13A is generally arcuate in shape and extends from a position near the refrigerant intake port 12 to a position corresponding to the portion B3. More specifically, the arcuate baffle plate 13A extends from the position near the intake port 12 to the portion B3 through the portions B1 and B2.

As is seen from FIG. 2, due to provision of the arcuate baffle plate 13A, the refrigerant intake chamber 7A at the portions B1, B2 and B3 is divided into first and second sections S1 and S2. The baffle plate 13A is so positioned that the refrigerant intake port 12 is exposed to the first section S1 of the intake chamber 7A. That is, the baffle plate 13A is so arranged as to obstruct a direct flow of the refrigerant gas from the intake port 12A to the inlet openings 3A of the portions B1, B2 and B3, that is, of the first, second and third piston bores 3.

As is seen from FIG. 1, bolts 50 are used for fixing the baffle plate 13A to the rear head 6A. A flow control valve "FCV" is integrally installed in the inner side of the rear head 6A within an area occupied by the portions B4, B5 and B6. Designated by reference P1 is a first passage which connects an inlet port of the flow control valve "FCV" with a crank chamber of the cylinder block 2, and designated by reference P2 is a second passage which connects an outlet port of the control valve "FCV" with the crank chamber of the cylinder block 2. Thus, by handling the control valve "FCV", a bypass connection between the intake and discharge chambers 7A and 8A is adjusted.

Designated by reference "a" is a first baffle rib raised from a bottom of the intake chamber 7A at a position between the refrigerant intake port 12A and the portion B6, and designated by reference "b" is a second baffle rib raised from the bottom of the intake chamber 7A at a position between the portions B3 and B4 and near the portion B4.

In operation, the refrigerant gas is led into the intake chamber 7A from the intake port 12A. However, due to provision of the baffle plate 13A and first and second baffle ribs "a" and "b" which are arranged in the above-mentioned manner, distribution of the refrigerant gas to the six inlet openings 3A of the first to sixth piston bores 3 is evenly and equally carried out.

That is, at the portions B1, B2 and B3, major part of the refrigerant gas from the intake port 12A is forced to flow in the first section S1 of the intake chamber 7A, being obstructed from directly flowing to the inlet openings 3A of the first, second and third piston bores 3. In other words, the inlet openings 3A of these first, second and third piston bores 3 are forced to have a longer intake passage for the refrigerant gas. Thus, the corresponding portions B1, B2 and B3, particularly the portion B1 can show a relatively low pressure due to a larger pressure loss produced at those portions. Of course, part of the refrigerant gas from the intake port 12A is directly led into the inlet openings 3A of the portions B1, B2 and B3.

While, at the portions B4, B5 and B6 where no baffle plate is arranged, the refrigerant gas flow into the inlet openings 3A of the fourth, fifth and sixth piston bores 3, that is, of the portions B4, B5 and B6 substantially consists of a first gas flow which runs counterclockwise (in FIG. 1) from the intake port 12A getting over the first baffle rib "a" and a second gas flow which runs clockwise (in FIG. 1) from the intake port 12A passing along the baffle plate 13A and getting over the second baffle rib "b". This flow causes the refrigerant gas pressure at such portions B4, B5 and B6 to show a controlled value.

Accordingly, the portions B1 to B6 of the refrigerant intake chamber 7A have a generally even pressure therethroughout, and thus undesirable intake pulsation of the refrigerant gas is suppressed or at least minimized.

Figure 3:
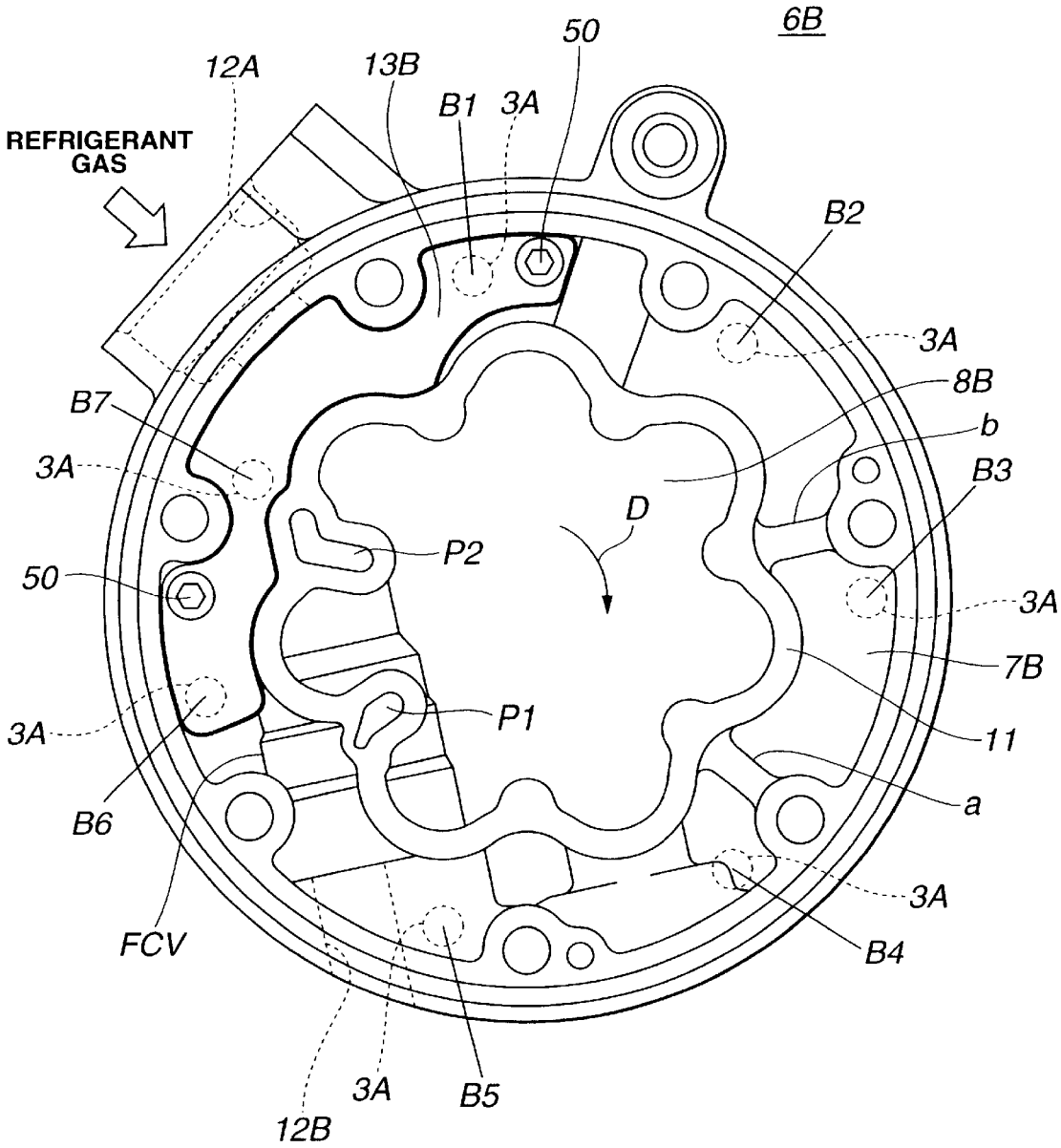
FIG. 3 is a view similar to FIG. 1, but showing a pulsation reducing structure employed in a swash plate type compressor of a second embodiment of the present invention.

Referring to FIG. 3, there is shown a rear head 6B which is employed in the swash plate type compressor of a second embodiment of the present invention. Since the rear head 6B of the second embodiment is similar in construction to that of the above-mentioned first embodiment 6A, only portions different form those of the first embodiment 6A will be described in detail in the following, and substantially same parts and portions as those of the first embodiment 6A are denoted by the same numerals.

In this second embodiment, the rear head 6B is constructed to incorporate with a compressor having seven pistons 18. That is, seven inlet openings 3A for the respective piston bores 3 are formed in the valve plate 9. It is to be noted that portions of the rear head 6B that face the seven inlet openings 3A are denoted by references B1, B2, B3, B4, B5, B6 and B7 respectively. It is further to be noted that these portions B1 to B7 correspond to first to seventh piston bores 3 with respect to a normal rotation direction of the rotation shaft 10, which is indicated by an arrow "D" in FIG. 3.

As shown in the drawing, in this second embodiment 6B, a generally arcuate baffle plate 13B is arranged in the refrigerant intake chamber 7B within an area occupied by the portions B6, B7 and B1. That is, the baffle plate 13B covers the area near the refrigerant intake port 12A.

Thus, in this second embodiment, the direct flow of the refrigerant gas from the intake port 12A to the inlet openings 3A of the portions B6, B7 and B1, that is, of the sixth, seventh and first piston bores 3 is obstructed by the baffle plate 13B. Thus, for the reasons as mentioned in the first embodiment 6A, the portions B6, B7 and B1 can show a relatively low pressure due to a larger pressure loss produced at those portions.

While, at the portions B2 and B5 where no baffle plate is arranged, the distance from the intake port 12A causes the portions B2 and B5 to show a controlled pressure which is generally the same as that produced at the portions B6, B7 and B1. At the portions B3 and B4 where no baffle plate is arranged, the refrigerant gas flow into the inlet openings 3A of the third and fourth piston bores 3, that is, of the portions B3 and B4 substantially consists of a first gas flow which runs counterclockwise (in FIG. 3) from the intake port 12A while being obstructed by the first baffle rib "a" and a second gas flow which runs clockwise (in FIG. 3) from the intake port 12A while being obstructed by the second baffle rib "b". This flow causes the refrigerant gas pressure at such portions B3 and B4 to show a controlled value.

Accordingly, the portions B1 to B7 of the refrigerant intake chamber 7B have a generally even pressure therethroughout, and thus undesirable intake pulsation of the refrigerant gas is suppressed or at least minimized.

Figure 4:
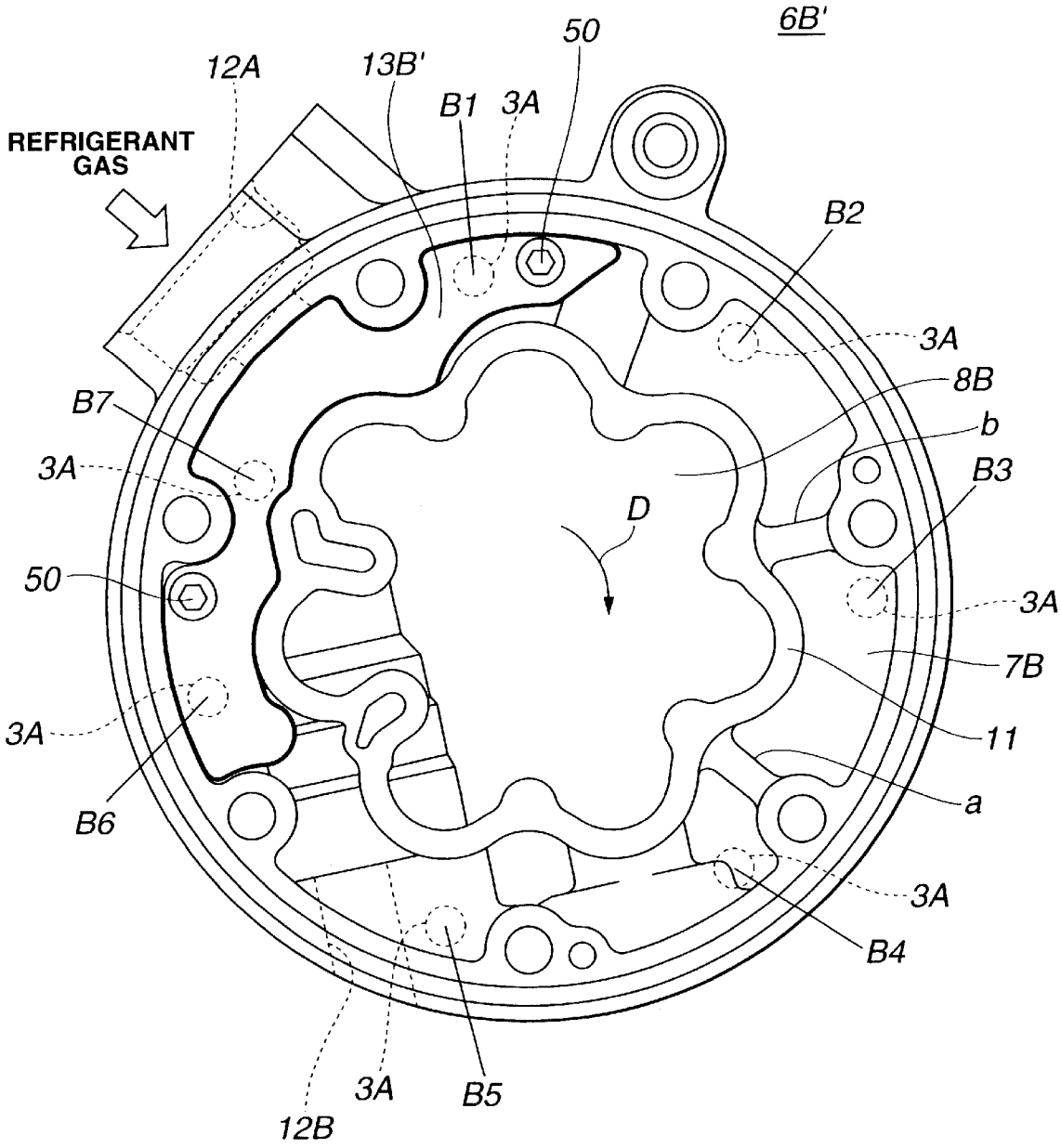
FIG. 4 is a view similar to FIG. 3, but showing a first modification of the second embodiment of the present invention.

Referring to FIG. 4, there is shown a first modification 6B' of the rear head 6B of the above-mentioned second embodiment.

As shown, in this modification 6B', the arcuate baffle plate 13B' is slightly longer than the baffle plate 13B of the second embodiment. That is, both ends of the baffle plate 13B' are slightly enlarged for enhancing the partitioning effect to the refrigerant gas flow.

Figure 5:
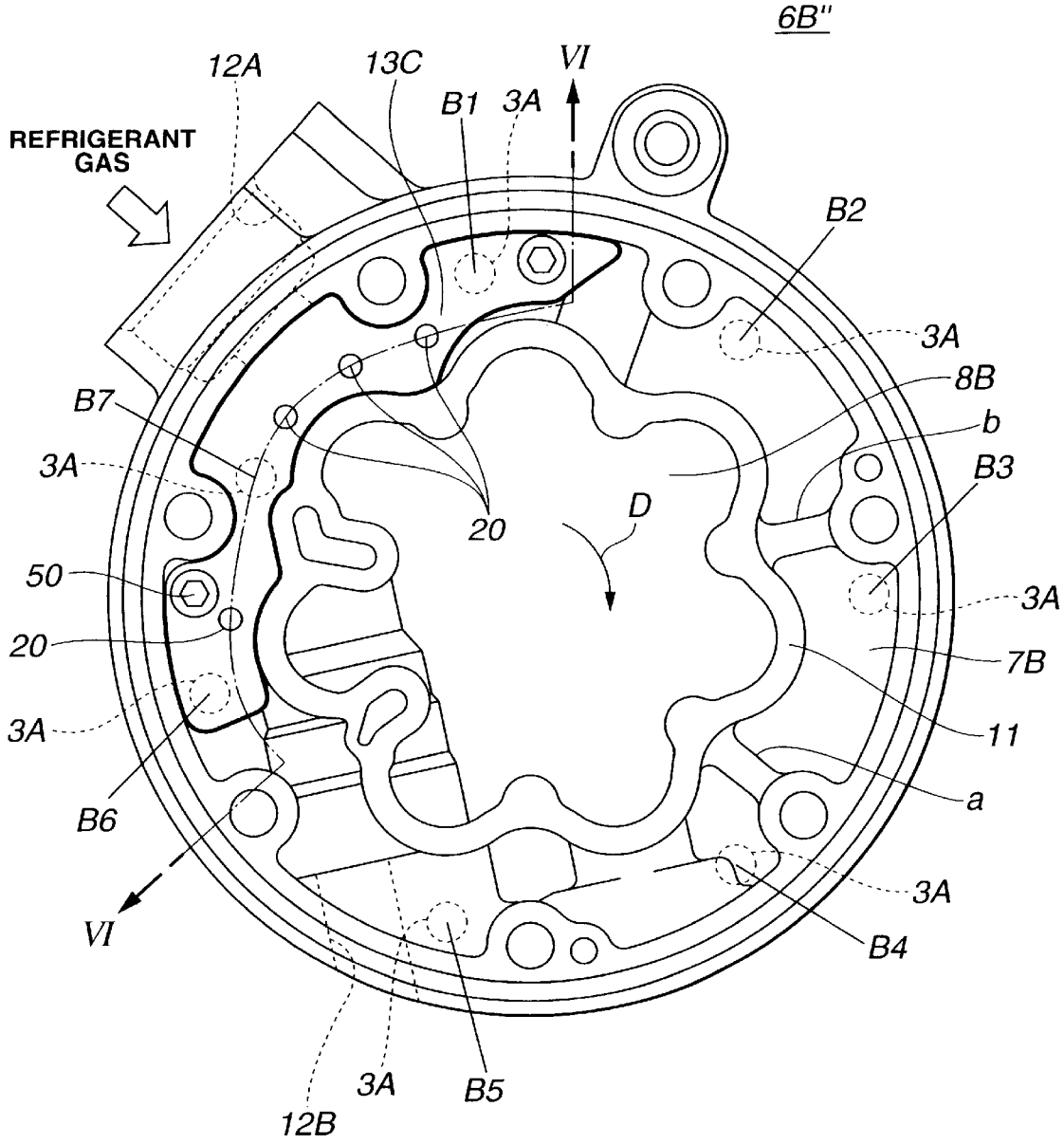
FIG. 5 is a view also similar to FIG. 3, but showing a second modification of the second embodiment of the present invention.
Figure 6:
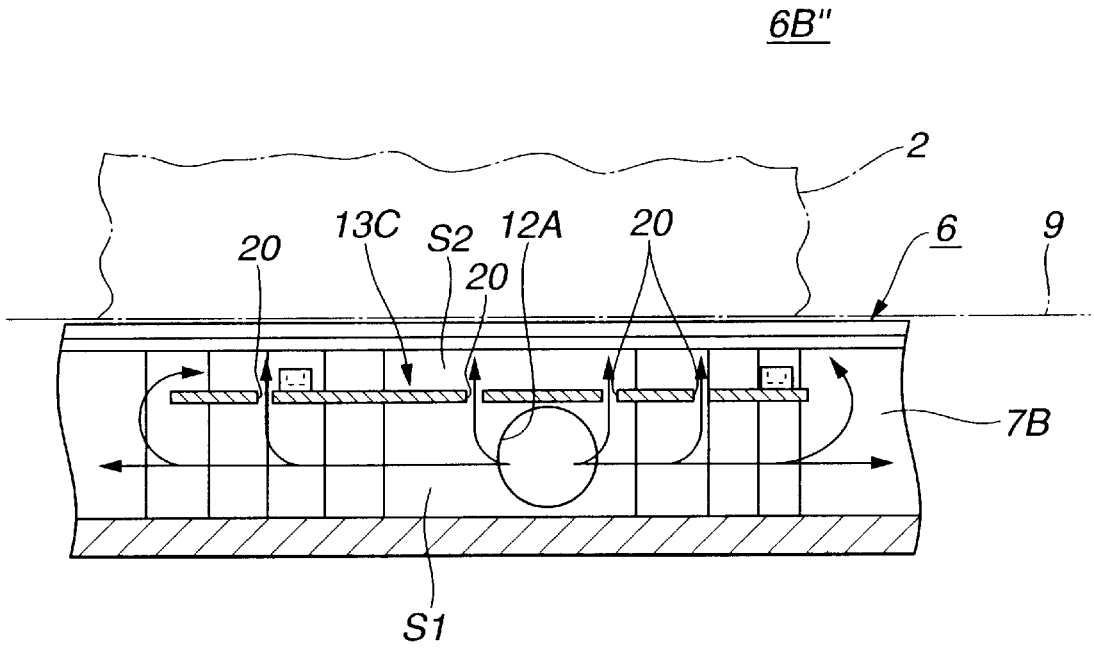
FIG. 6 is a sectional view taken along the line VI—VI of FIG. 5.

Referring to FIGS. 5 and 6, particularly FIG. 5, there is shown a second modification 6B" of the rear head 6B of the above-mentioned second embodiment.

In this second modification 6B", an apertured arcuate baffle plate 13B" is employed in place of the baffle plate 13B of the second embodiment. That is, a plurality of small circular openings 20 are formed in the baffle plate 13B", which are arranged to make a line as shown in FIG. 5. As is seen from FIG. 6, due to provision of the small openings 20, part of the refrigerant gas flowing in the first section S1 of the refrigerant intake chamber 7B can flow into the second section S2 through the openings 20, which enhances pressure controlling at the portions B6, B7 and B1.

Referring to FIGS. 7 to 14, there is shown a rear head 6C which is employed in the swash plate type compressor of a third embodiment of the present invention. Since the rear head 6C of the third embodiment is similar in construction to that of the above-mentioned first embodiment 6A, only portions different from those of the first embodiment will be described in detail in the following, and substantially same parts and portions as those of the first embodiment 6A are denoted by the same numerals.

Figure 7:
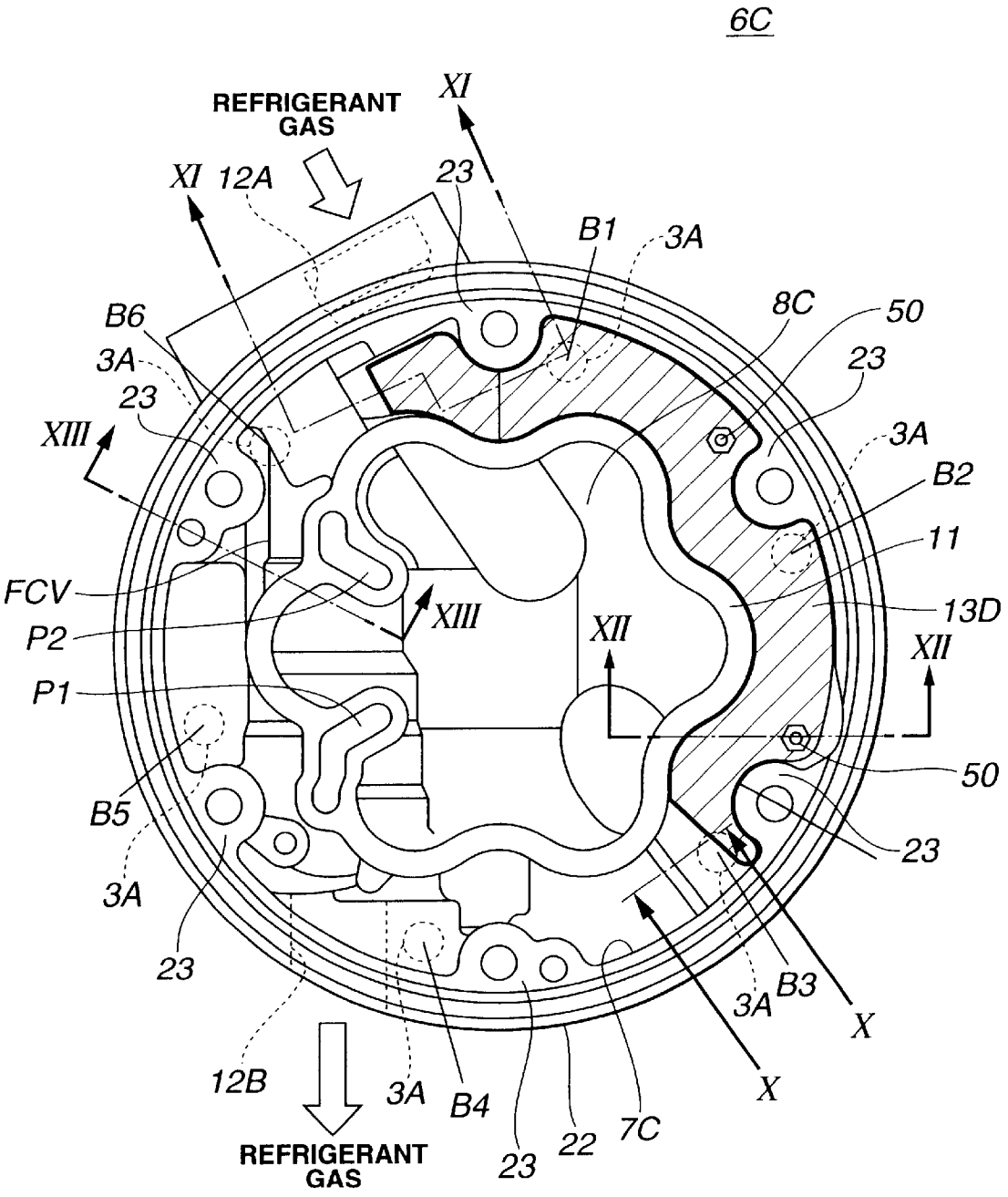
FIG. 7 is a view similar to FIG. 1, but showing a pulsation reducing structure employed in a swash plate type compressor of a third embodiment of the present invention.
Figure 9:
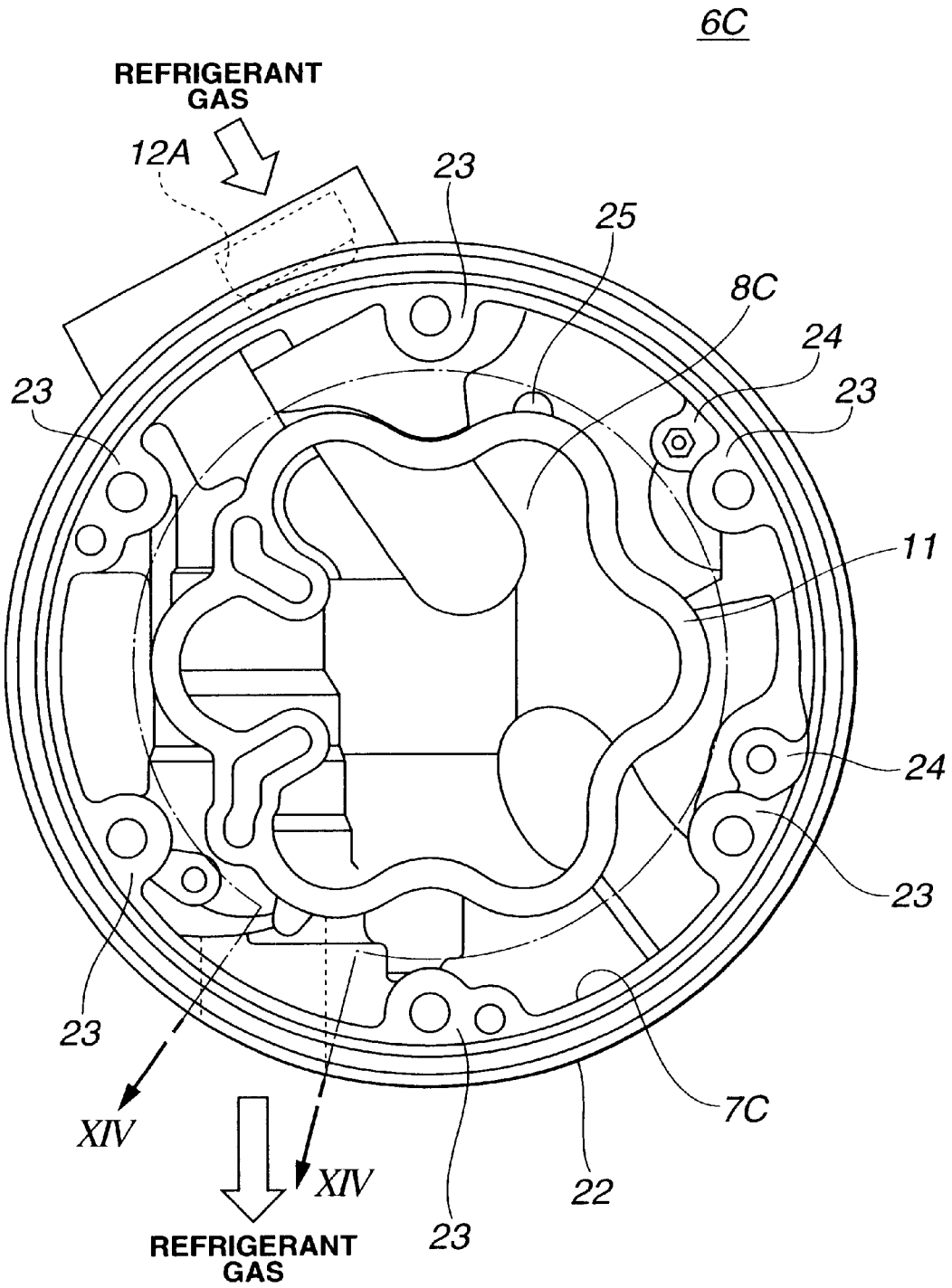
FIG. 9 is a plan view of a rear head employed in the swash plate type compressor of the third embodiment.
Figure 10:
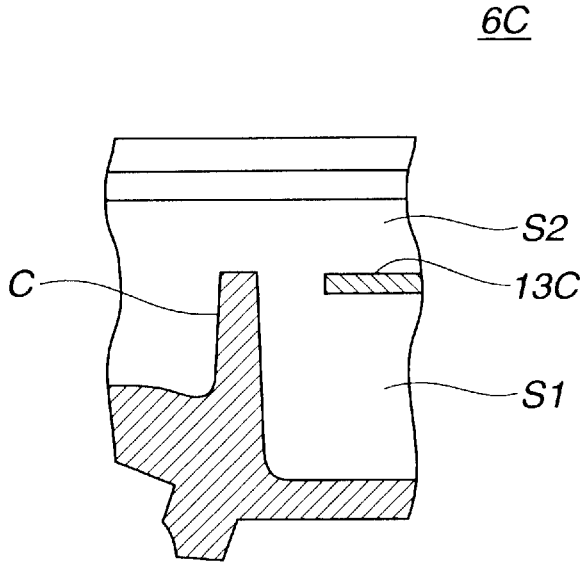
FIG. 10 is a sectional view taken along the line X—X of FIG. 7.

As is seen from FIGS. 7 and 9, in the third embodiment 6C, a refrigerant discharge port 12B communicated with the refrigerant discharge chamber 8C is provided at a generally opposite position of the refrigerant intake port 12A, like in the above-mentioned first and second embodiments 6A and 6B.

As is seen from FIG. 7, a generally arcuate baffle plate 13C is arranged in the refrigerant intake chamber 7C within an area occupied by the portions B1, B2 and a half of the portion B3.

As is seen from FIG. 9, two column portions 24 are integrally formed in the inner side of the rear head 6C, each having a threaded bore for receiving the above-mentioned bolt 50. That is, the arcuate baffle plate 13C is put on the column portions 24 and secured thereto by the bolts 50 engaged with the threaded bores. Designated by numeral 25 is a projection for supporting the arcuate baffle plate 13C.

Figure 8:
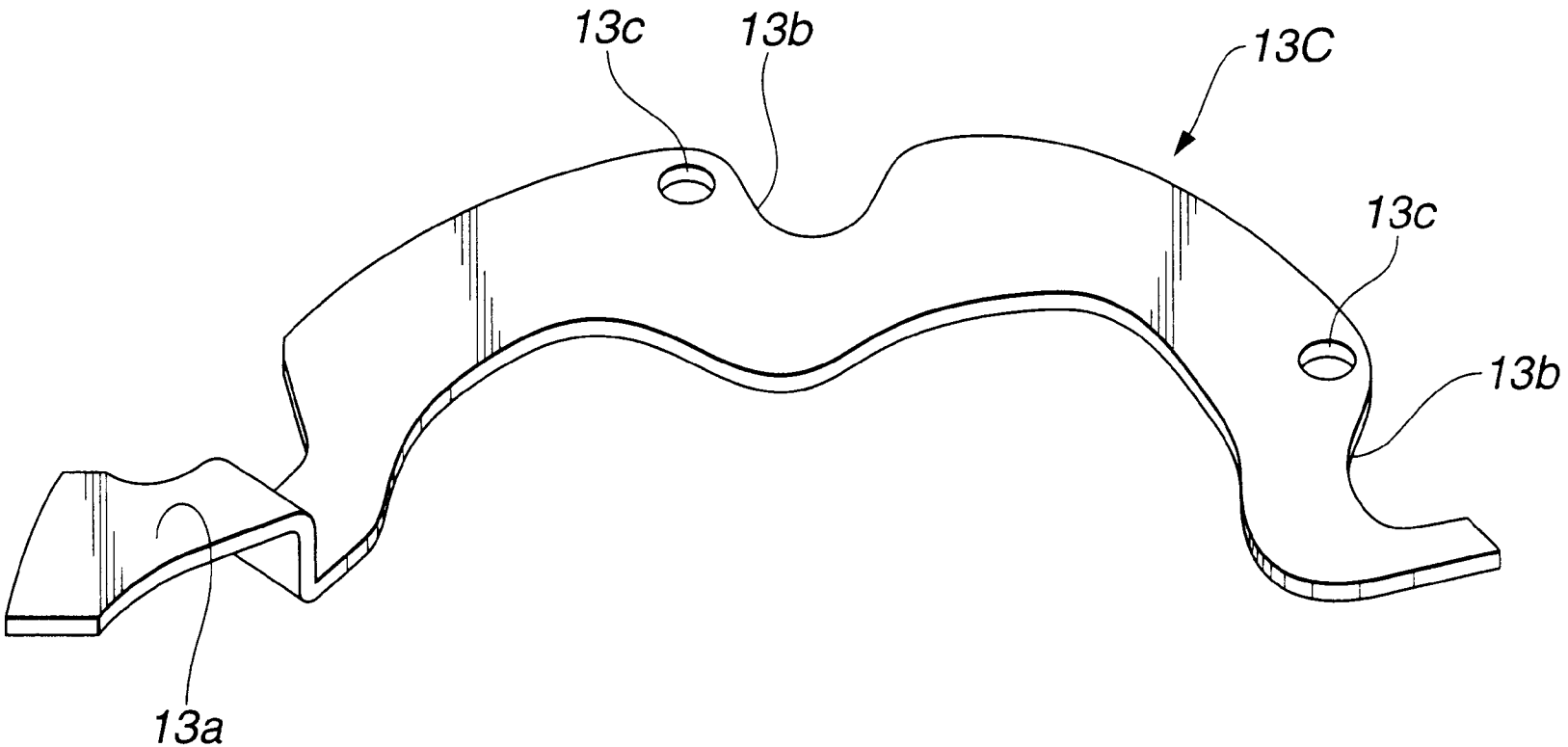
FIG. 8 is a perspective view of an partition member employed in the third embodiment.

FIG. 8 shows in detail the arcuate baffle plate 13C. As shown, the baffle plate 13C has a raised left end 13*a* which is to be positioned at the refrigerant intake port 12A. As is seen from FIG. 11, the raised left end 13*a* is positioned above the refrigerant intake port 12A not to extend across the intake port 12A, and thus the flow of the refrigerant gas from the port 12A into the first section S1 is smoothly carried out.

Referring back to FIG. 8, the baffle plate 13C has two rounded cut portions 13*b* for intimately receiving therein corresponding two of the column portions 23 and two bolt openings 13*c* through which the bolts 50 pass.

The arrangement of the arcuate baffle plate 13C in the refrigerant intake chamber 7C is well understood from FIGS. 10, 11, 12 and 13, which are sectional views taken along the line X—X, line XI—XI, line XII—XII and line XIII—XIII of FIG. 7.

Figure 11:
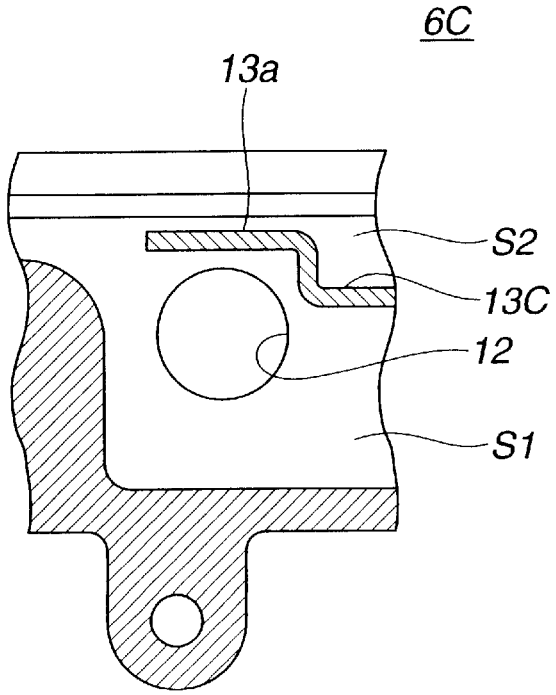
FIG. 11 is a sectional view taken along the line XI—XI of FIG. 7.
Figure 12:
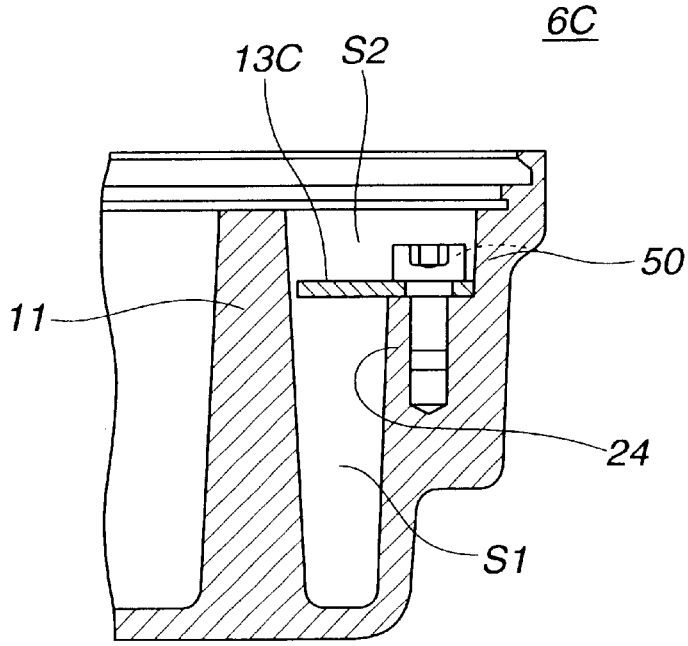
FIG. 12 is a sectional view taken along the line XII—XII of FIG. 7.
Figure 13:
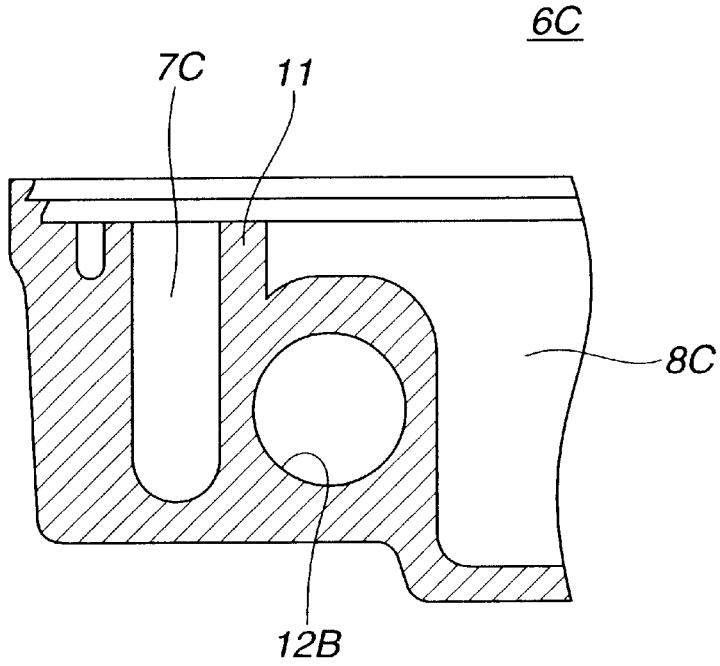
FIG. 13 is a sectional view taken along the line XIII—XIII of FIG. 7.

As is seen from FIG. 11, the raised left end 13*a* of the baffle plate 13C is arranged not to obstruct the intake port 12A. As is seen from FIG. 10, the other end of the baffle plate 13C is positioned near a baffle rib "c" positioned in the portion B3. As is seen from FIG. 12, the baffle plate 13C is secured to the column portion 24 by the bolt 50, and as is seen from FIG. 13, the refrigerant discharge port 12B is formed in an enlarged lower portion of the annular partition wall 11.

Figure 14:
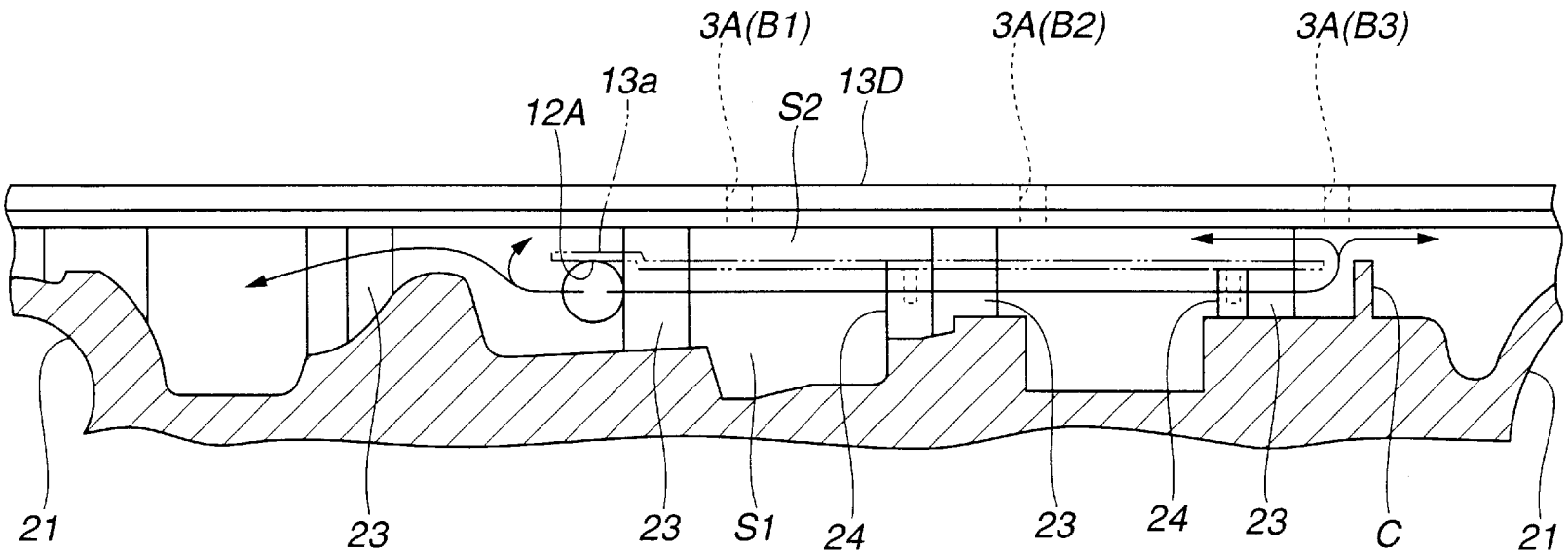
FIG. 14 is a sectional view taken along the line XIV—XIV of FIG. 9.

FIG. 14 is a sectional view taken along the line XIV—XIV of FIG. 9, showing the flow of the refrigerant gas led from the intake port 12A to the intake chamber 7C. As is seen from this drawing, due to provision of the baffle plate 13C, direct flow of the refrigerant gas from the intake port 12A to the inlet openings 3A of the partitions B1, B2 and B3 is blocked, which brings about an even pressurizing throughout the portions B1 to B6.

Figure 15:
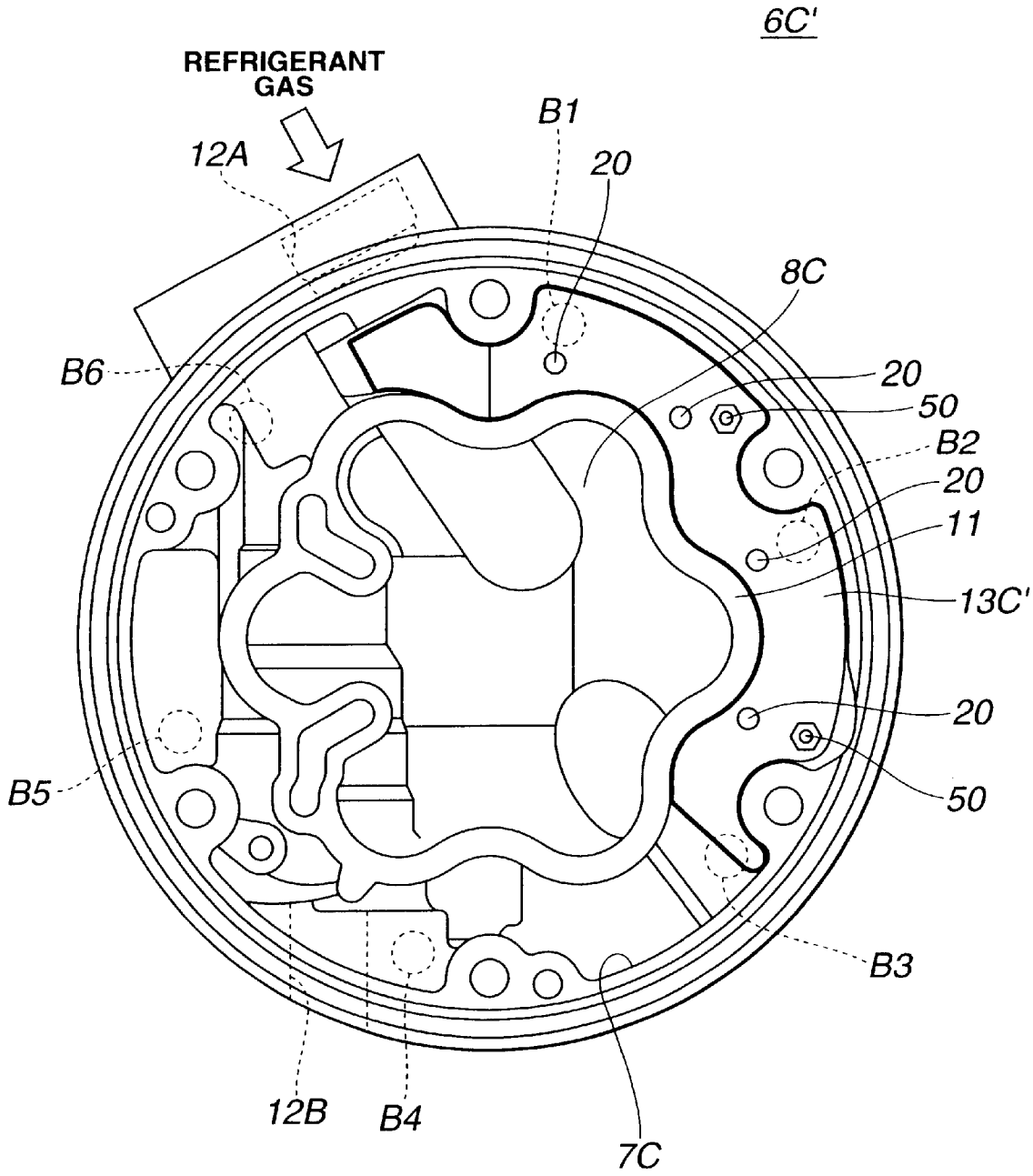
FIG. 15 is a view similar to FIG. 9, but showing a modification of the third embodiment of the present invention.

Referring to FIG. 15, there is shown a modification 6C' of the rear head 6C of the above-mentioned third embodiment.

As shown, in this modification 6C', a plurality of small circular openings 20 are formed in the baffle plate 13C'. As has been mentioned hereinbefore, due to provision of the openings 20, the pressure at the portions B1, B2 and B3 is much finely controlled.

If desired, the following modifications may be further carried out in the invention. That is, in case wherein the intake pressure at the position where the baffle plate is located is relatively low, the baffle plate may be formed with one or several small openings. With this measure, the inlet openings 3A of the valve plate 9 show even pressure therethroughout.

Although the above-description is directed to the swash plate type compressor, the concept of the present invention is applicable to other type compressors, that is, swing type compressor, rotary type compressor, scroll type compressor and the like.

The entire contents of Japanese Patent Applications 2000-267555 (filed Sep. 4, 2000) and 2000-391183 (filed Dec. 22, 2000) are incorporated herein by reference.

Although the invention has been described above with reference to the embodiments of the invention, the invention is not limited to such embodiments as described above. Various modifications and variations of such embodiments may be carried out by those skilled in the art, in light of the above description.

What is claimed is:

1. A compressor comprising:

a cylinder block;

compressing means installed in said cylinder block to compress a refrigerant gas led thereinto;

a valve plate connected to a rear end of said cylinder block, said valve plate having a group of inlet openings which are connected to said compressing means to introduce a refrigerant gas into said compressing means and another group of outlet openings which are connected to said compressing means to discharge the refrigerant gas thus compressed from said compressing means;

a rear head connected to said valve plate, said rear head having an intake chamber exposed to said inlet openings and a discharge chamber exposed to said outlet openings, said intake chamber surrounding said charge chamber, said rear head having an intake port connected to said annular intake chamber and a discharge port connected to said circular discharge chamber; and a baffle plate installed in said intake chamber to obstruct a direct flow of the refrigerant gas from said intake port to said inlet openings.

2. A swash plate type compressor comprising:

a cylinder block;

a rotation shaft rotatably held in said cylinder block;

a swash plate swingably connected to said rotation shaft to rotate therewith;

a plurality of piston bores circumferentially arranged about said rotation shaft;

a plurality of pistons operatively received in said piston bores respectively, each piston having a holding portion that slidably holds a peripheral portion of said swash plate, so that when the rotation shaft is rotated about its axis, the swash plate pulls and pushes the pistons thereby to reciprocate the same;

a valve plate connected to a rear end of said cylinder block, said valve plate having a group of inlet openings connected to the piston bores respectively and another group of outlet openings connected to the piston bores respectively;

a rear head connected to said valve plate, said rear head having an intake chamber exposed to said inlet openings and a discharge chamber exposed to said outlet openings, said intake chamber surrounding said discharge chamber, said rear head having an intake port connected to said annular intake chamber and a discharge port connected to said circular discharge chamber; and a baffle plate installed in said intake chamber to obstruct a direct flow of a refrigerant gas from said intake port to said inlet openings.

3. A swash plate type compressor as claimed in claim 2, in which said baffle plate is sized and shaped to obstruct the direct flow of the refrigerant gas from said intake port to a given group of said inlet openings.

4. A swash plate type compressor as claimed in claim 3, in which said given group of the inlet openings are positioned in the vicinity of said intake port.

5. A swash plate type compressor as claimed in claim 4, in which said given group of the inlet openings are at least three in number.

6. A swash plate type compressor as claimed in claim 3, in which said baffle plate is formed with a plurality of openings through which part of the refrigerant gas from said intake port is directly led into the given group of the inlet openings.

7. A swash plate type compressor as claimed in claim 2, in which said baffle plate is generally arcuate in shape and snugly received in a part of said annular intake chamber.

8. A swash plate type compressor as claimed in claim 7, in which said baffle plate is formed with a raised end in the vicinity of said intake port, said raised end being so positioned as not to extend across said intake port.

9. A swash plate type compressor as claimed in claim 2, in which said baffle plate is secured to said rear head by means of bolts.

10. A swash plate type compressor as claimed in claim 2, further comprising baffle ribs integrally formed on a bottom of said annular intake chamber of the rear head in a manner to obstruct a flow of the refrigerant gas in and along the annular intake chamber.

11. A swash plate type compressor as claimed in claim 2, in which said annular intake chamber and said circular discharge chamber are partitioned by a generally annular wall which is raised from a bottom portion of said rear head.

12. A swash plate type compressor as claimed in claim 11, in which said rear head has a flow control valve connected thereto, and in which said annular wall is formed with a first passage through which an intake port of the control valve is connected with a crank chamber of said cylinder block and a second passage through which an outlet port of said control valve is connected with the crank chamber of said cylinder block.

13. A swash plate type compressor as claimed in claim 2, in which said intake and discharge ports of said rear head are provided at diametrically opposite portions of said rear head.

14. A compressor comprising:

a cylinder block;

compressing means installed in said cylinder block to compress a refrigerant gas led thereinto;

a valve plate connected to a rear end of said cylinder block, said valve plate having a group of inlet openings connected to said piston bores respectively and another group of outlet openings connected to said piston bores respectively, each outlet opening having a valve plate that permits only a discharge flow of the refrigerant gas from said piston bore;

a rear head connected to said valve plate, said rear head having a generally annular intake chamber exposed to said inlet openings and a generally circular discharge chamber exposed to said outlet openings, said rear head having an intake port connected to said annular intake chamber and a discharge port connected to said circular discharge chamber; and an arcuate baffle plate installed in said generally annular intake chamber in a manner to obstruct a direct flow the refrigerant gas from said intake port to a given group of said inlet openings.

15. A swash plate type compressor comprising:

a cylinder block;

a rotation shaft rotatably held in said cylinder block;

a swash plate swingably connected to said rotation shaft to rotate therewith;

a plurality of piston bores defined in said cylinder block and circumferentially arranged about said rotation shaft;

a plurality of pistons operatively received in said piston bores respectively, each piston having a holding portion that slidably holds a peripheral portion of said swash plate, so that when the rotation plate is rotated about its axis, the swash plate pulls and pushes the pistons thereby to reciprocate the same;

a valve plate connected to a rear end of said cylinder block, said valve plate having a group of inlet openings connected to said piston bores respectively and another group of outlet openings connected to said piston bores respectively, each outlet opening having a valve plate that permits only a discharge flow of a refrigerant gas from said piston bore;

a rear head connected to said valve plate, said rear head having a generally annular intake chamber exposed to said inlet openings and a generally circular discharge chamber exposed to said outlet openings, said rear head having an intake port connected to said annular intake chamber and a discharge port connected to said circular discharge chamber; and an arcuate baffle plate installed in said generally annular intake chamber in a manner to obstruct a direct flow the refrigerant gas from said intake port to a given group of said inlet openings.

* * * * *